US009366207B2

(12) United States Patent
Terashima et al.

(10) Patent No.: US 9,366,207 B2
(45) Date of Patent: Jun. 14, 2016

(54) FUEL INJECTOR

(75) Inventors: Hirokazu Terashima, Ludwigsburg (DE); Markus Gesk, Karlsbad (DE); Friedrich Moser, Magstadt (DE); Volker Sohm, Yongin-si (KR)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 13/823,666

(22) PCT Filed: Jul. 26, 2011

(86) PCT No.: PCT/EP2011/062789

§ 371 (c)(1),
(2), (4) Date: Jun. 17, 2013

(87) PCT Pub. No.: WO2012/034757

PCT Pub. Date: Mar. 22, 2012

(65) Prior Publication Data

US 2013/0256430 A1 Oct. 3, 2013

(30) Foreign Application Priority Data

Sep. 16, 2010 (DE) ..... 10 2010 040 898

(51) Int. Cl.

| | |
|---|---|
| ***B05B 1/30*** | (2006.01) |
| ***F02M 51/06*** | (2006.01) |
| ***H01F 7/16*** | (2006.01) |

(52) U.S. Cl.

CPC ..... *F02M 51/06* (2013.01); *F02M 51/0682* (2013.01); *H01F 7/1607* (2013.01); *F02M 2200/08* (2013.01); *F02M 2200/9061* (2013.01)

(58) Field of Classification Search

USPC ..... 239/569–586

See application file for complete search history.

(56) References Cited

U.S. PATENT DOCUMENTS

| | | | | |
|---|---|---|---|---|
| 4,662,567 | A | 5/1987 | Knapp | |
| 4,996,764 | A * | 3/1991 | Babitzka | 29/608 |
| 5,115,982 | A | 5/1992 | Mesenich | |

(Continued)

FOREIGN PATENT DOCUMENTS

| | | |
|---|---|---|
| DE | 34 45 405 | 6/1986 |
| DE | 197 39 150 | 3/1999 |

(Continued)

OTHER PUBLICATIONS

International Search Report, PCT International Application No. PCT/EP2011/062789, dated Oct. 5, 2011.

*Primary Examiner* — Len Tran
*Assistant Examiner* — Adam J Rogers
(74) *Attorney, Agent, or Firm* — Norton Rose Fulbright US LLP

(57) ABSTRACT

A fuel injector for fuel-injection systems of internal combustion engines. The valve includes an electromagnetic actuating element having a solenoid coil, a fixed core, an outer magnetic-circuit component and a movable armature to actuate a valve-closure member which cooperates with a valve-seat surface provided on a valve-seat member. The valve is characterized by its extremely small outside dimensions. The entire axially movable valve needle, including armature and valve-closure member, has a mass of only m<=0.8 g. The valve is suitable as a fuel injector, especially for use in fuel-injection systems of mixture-compressing internal combustion engines with externally supplied ignition.

10 Claims, 3 Drawing Sheets

(56) References Cited

U.S. PATENT DOCUMENTS

| | | | | |
|---|---|---|---|---|
| 5,330,153 | A * | 7/1994 | Reiter | 251/129.21 |
| 6,076,802 | A | 6/2000 | Maier | |
| 6,186,472 | B1 | 2/2001 | Reiter | |
| 6,299,079 | B1 | 10/2001 | Noller et al. | |
| 6,575,385 | B1 * | 6/2003 | Stier | 239/102.2 |
| 6,679,435 | B1 * | 1/2004 | Noller et al. | 239/5 |
| 7,344,093 | B2 | 3/2008 | Yamamoto et al. | |
| 2005/0133635 | A1 * | 6/2005 | Hornby | 239/533.2 |
| 2006/0249601 | A1 * | 11/2006 | Thoemmes | 239/585.4 |
| 2007/0075166 | A1 * | 4/2007 | Tsuchiya et al. | 239/585.1 |
| 2013/0087639 | A1 * | 4/2013 | Nakai et al. | 239/585.1 |

FOREIGN PATENT DOCUMENTS

| | | | |
|---|---|---|---|
| DE | 103 32 348 | | 2/2005 |
| DE | 10 2004 062 191 | | 8/2005 |
| EP | 0 387 179 | | 9/1990 |
| EP | 1 878 908 | | 1/2008 |
| JP | H11500509 | | 1/1999 |
| JP | 2001082623 | A | 3/2001 |
| JP | 2001509855 | | 7/2001 |
| JP | 2002 048031 | | 2/2002 |
| JP | 2003003934 | | 1/2003 |
| JP | 2005233048 | | 9/2005 |
| WO | WO 91/11605 | | 8/1991 |
| WO | WO 99/66196 | | 12/1999 |

* cited by examiner

FUEL INJECTOR

FIELD OF THE INVENTION

The present invention is based on a fuel injector for a fuel-injection system of an internal combustion engine.

BACKGROUND INFORMATION

The German Patent DE 38 25 134 A1 discusses a fuel injector that includes an electromagnetic actuating element having a solenoid coil, having an internal pole and having an outer magnetic-circuit component and a movable valve-closure member that cooperates with a valve seat assigned to a valve-seat member. The injector is surrounded by a plastic coating, the plastic coating first and foremost extending in the axial direction, surrounding the fitting used as internal pole and the solenoid coil. At least in the area surrounding the solenoid coil, ferromagnetic fillers conducting magnetic lines of force are introduced in the plastic coating. In this respect, the fillers surround the solenoid coil in the circumferential direction. The fillers are pieces of metal reduced to fine grain and having soft-magnetic properties. The small metal particles embedded magnetically in the plastic have a more or less globular shape and are magnetically isolated individually, and thus have no metallic contact among themselves, so that no effective magnetic-field formation occurs. However, standing in the way of the positive aspect of a very high electrical resistance thereby resulting is also an extremely high magnetic resistance, that is reflected in a considerable power loss, and therefore determines the functional properties which are negative in the overall balance.

A fuel injector is also discussed in DE 103 32 348 A1, which has the feature of a relatively compact construction. In this valve, the magnetic circuit is formed by a solenoid coil, a fixed internal pole, a movable solenoid armature, as well as an outer magnetic-circuit component in the form of a magnetic cup. For a slender and compact construction of the valve, a plurality of thin-walled valve sleeves are employed, which are used both as fitting and as valve-seat support and guide section for the solenoid armature. The thin-walled non-magnetic sleeve running within the magnetic circuit forms an air gap, via which the magnetic lines of force pass over from the outer magnetic-circuit component to the solenoid armature and internal pole. A fuel injector of a comparable type of construction is shown again in FIG. 1, and is explained in greater detail below in order to better understand the present invention.

In addition, JP 2002-48031 A discusses a fuel injector which likewise features a thin-walled sleeve design approach, the deep-drawn valve sleeve extending over the entire length of the valve, and in the magnetic-circuit area, having a magnetic separation point, at which the otherwise martensitic structure is interrupted. This non-magnetic intermediate section is disposed at the level of the area of the working air gap between the solenoid armature and internal pole and in relation to the solenoid coil to such an extent that as effective a magnetic circuit as possible is created. Such a magnetic separation is also used to increase the DFR (dynamic flow range) compared to known valves having conventional electromagnetic circuits. However, such designs are then again associated with considerable additional costs in manufacturing. In addition, the introduction of such a magnetic separation having a non-magnetic sleeve section leads to a different geometrical design compared to valves without a magnetic separation.

SUMMARY OF THE INVENTION

The fuel injector according to the present invention having the characterizing features set forth herein has the advantage of an especially compact type of construction. The valve has an extremely small outside diameter, such as for the technical world in the field of manifold injectors for internal combustion engines, until now, seemed to be impossible to manufacture while maintaining the highest functionality. Because of this very small dimensioning, it is possible to implement the mounting of the fuel injector much more flexibly than conceivable under the state of the art. Thus, due to the modularly constructed valve, the fuel injectors of the present invention may be installed very compatibly in widely differing receiving bores of the various vehicle manufacturers with numerous "extended tip" variants, thus, injector variants varying in the length, without changes to the length of the valve needle or the length of the valve sleeve. In this context, the sealing ring sitting on the outer magnetic-circuit component and sealingly against the wall of the receiving bore on the intake manifold is easily displaceable.

Advantageously, the new geometry of the fuel injector was determined, first and foremost, under the boundary conditions with regard to the variables $q_{min}$, $F_F$ and $F_{max}$. In order to be able to realize the extremely small outside dimensions of the magnetic circuit accompanied by full functionality, according to the invention, the outside diameter $D_A$ of the armature was set to 4.0 mm<$D_A$<5.0 mm, and the armature was shortened considerably. According to the invention, the small outside diameter $D_A$ and the small axial extension of the armature results in an especially light valve needle, so that as a consequence, there are marked noise reductions during operation of the fuel injector compared to the known manifold injectors.

It is especially advantageous that, concomitant with the dimensioning of the fuel injector according to the invention, the DFR (dynamic flow range) is able to be increased to >17, and hence increased considerably compared to the DFR customary for known injectors. The great flexibility of use of such an optimized fuel injector also becomes clear from the fact that in the area of the working air gap in the valve sleeve, either a zone having a magnetic flux density B<0.01 T may be provided as magnetic separation, or a zone having a magnetic flux density 0.01 T<B<0.15 T may be provided as magnetic choke.

Advantageous further refinements of and improvements to the fuel injector indicated herein are rendered possible by the measures delineated in the further descriptions herein.

Exemplary embodiments of the present invention are depicted in simplified fashion in the drawing and explained in greater detail in the description below.

DETAILED DESCRIPTION

Figure 1:
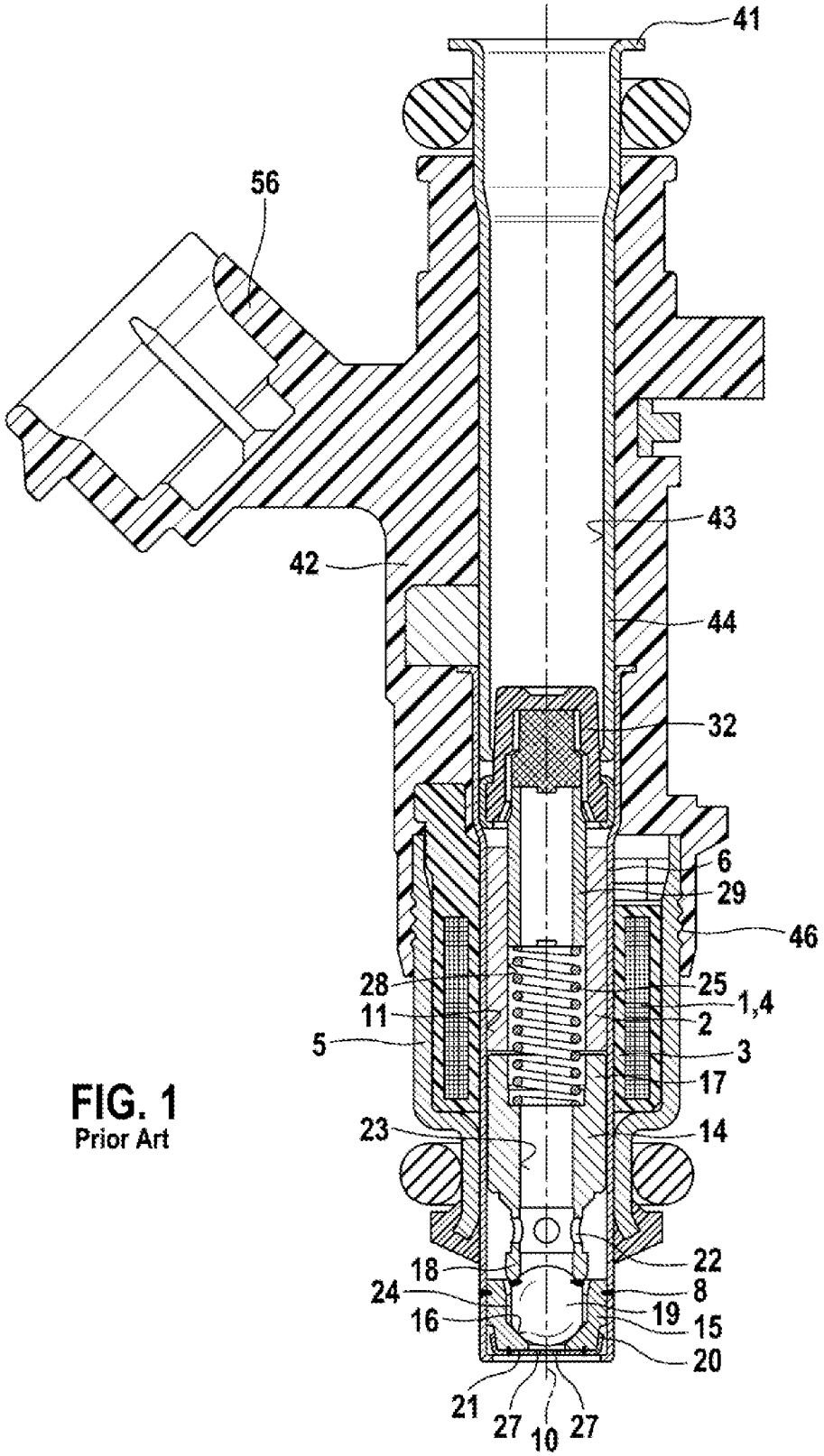
FIG. 1 Prior Art
FIG. 1 shows an electromagnetically operable valve in the form of a fuel injector according to the prior art.

In order to understand the present invention, FIG. 1 shows, by way of example, an electromagnetically operable valve in the form of a fuel injector for fuel-injection systems of mixture-compressing internal combustion engines with externally supplied ignition according to the related art.

The valve has a substantially tubular core 2 which is surrounded by a solenoid coil 1 and is used as internal pole and partially as fuel passage. Solenoid coil 1 is surrounded completely in the circumferential direction by an outer, sleeve-shaped and graduated, e.g., ferromagnetic valve casing 5, which represents an outer magnetic-circuit component used as external pole. Solenoid coil 1, core 2 and valve casing 5 together form an electrically excitable actuating element.

While solenoid coil 1, embedded in a coil form 3 and having a winding 4, surrounds a valve sleeve 6 from outside, core 2 is mounted in an inner opening 11 in valve sleeve 6, the opening running concentrically relative to a longitudinal valve axis 10. Valve sleeve 6 is elongated and thin-walled. Opening 11 is used, inter alia, as a guide opening for a valve needle 14 movable axially along longitudinal valve axis 10. Valve sleeve 6 extends in the axial direction, for example, over approximately half the total axial extension of the fuel injector.

Besides core 2 and valve needle 14, in addition, a valve-seat member 15 is disposed in opening 11 and is secured to valve sleeve 6 by a welded seam 8, for example. Valve-seat member 15 has a fixed valve-seat surface 16 as valve seat. For example, valve needle 14 is formed by a tubular armature 17, a likewise tubular needle section 18 and a spherical valve-closure member 19, valve-closure member 19 being joined firmly to needle section 18 by a welded seam, for instance. Situated at the downstream end face of valve-seat member 15 is a, for example, cup-shaped spray orifice disk 21, whose bent, circumferentially-encircling retention rim 20 is directed upward contrary to the direction of flow. Valve-seat member 15 and spray orifice disk 21 are joined firmly, e.g., by a circumferential, impervious welded seam. One or more transverse openings 22 are provided in needle section 18 of valve needle 14, so that fuel flowing through armature 17 in an inner longitudinal bore hole 23 is able to go outward and flow along valve-closure member 19, e.g., along flattenings 24 up to valve-seat surface 16.

The injector is actuated electromagnetically in known manner. The electromagnetic circuit, having solenoid coil 1, inner core 2, outer valve casing 5 and armature 17, is used for the axial movement of valve needle 14, and consequently for opening the injector against the spring force of a return spring 25 acting upon valve needle 14, and for closing the injector. The end of armature 17 facing away from valve-closure member 19 is aligned with core 2. For instance, instead of core 2, a cover part serving as internal pole and closing the magnetic circuit may also be provided.

Spherical valve-closure member 19 cooperates with valve-seat surface 16 of valve-seat member 15, the valve-seat surface being formed in the axial direction downstream of a guide opening in valve-seat member 15 and tapering frusto-conically in the direction of flow. Spray orifice disk 21 has at least one, e.g., four spray orifices 27 formed by eroding, laser drilling or punching.

Among other things, the insertion depth of core 2 in the injector is decisive for the lift of valve needle 14. When solenoid coil 1 is not excited, the one end position of valve needle 14 is determined by the contact of valve-closure member 19 with valve-seat surface 16 of valve-seat member 15, while the other end position of valve needle 14 when solenoid coil 1 is excited results from the contact of armature 17 with the downstream end of the core. The lift is adjusted by an axial shift of core 2 which is subsequently joined firmly to valve sleeve 6, according to the desired position.

In addition to return spring 25, an adjusting element in the form of an adjusting sleeve 29 is inserted into a flow bore hole 28 in core 2, the flow bore hole running concentrically relative to longitudinal valve axis 10 and being used to convey the fuel in the direction of valve-seat surface 16. Adjusting sleeve 29 is used to adjust the preloading of return spring 25 which is resting against adjusting sleeve 29 and which, in turn, supports itself with its opposite side against valve needle 14 in the area of armature 17, the dynamic spray-discharge quantity also being adjusted by adjusting sleeve 29. A fuel filter 32 is situated above adjusting sleeve 29 in valve sleeve 6.

The inflow-side end of the valve is formed by a metallic fuel-inlet connection 41 which is encircled by a plastic coating 42 surrounding, stabilizing and protecting it. A flow bore hole 43 of a pipe 44 of fuel-inlet connection 41 running concentrically relative to longitudinal valve axis 10 is used as fuel inlet. For example, plastic coating 42 is sprayed on in a manner that the plastic directly surrounds parts of valve sleeve 6 and of valve casing 5. A secure sealing is attained, for instance, via a labyrinth seal 46 at the periphery of valve casing 5. An electrical power plug 56, injected-molded on, belongs to plastic coating 42, as well.

Figure 2:
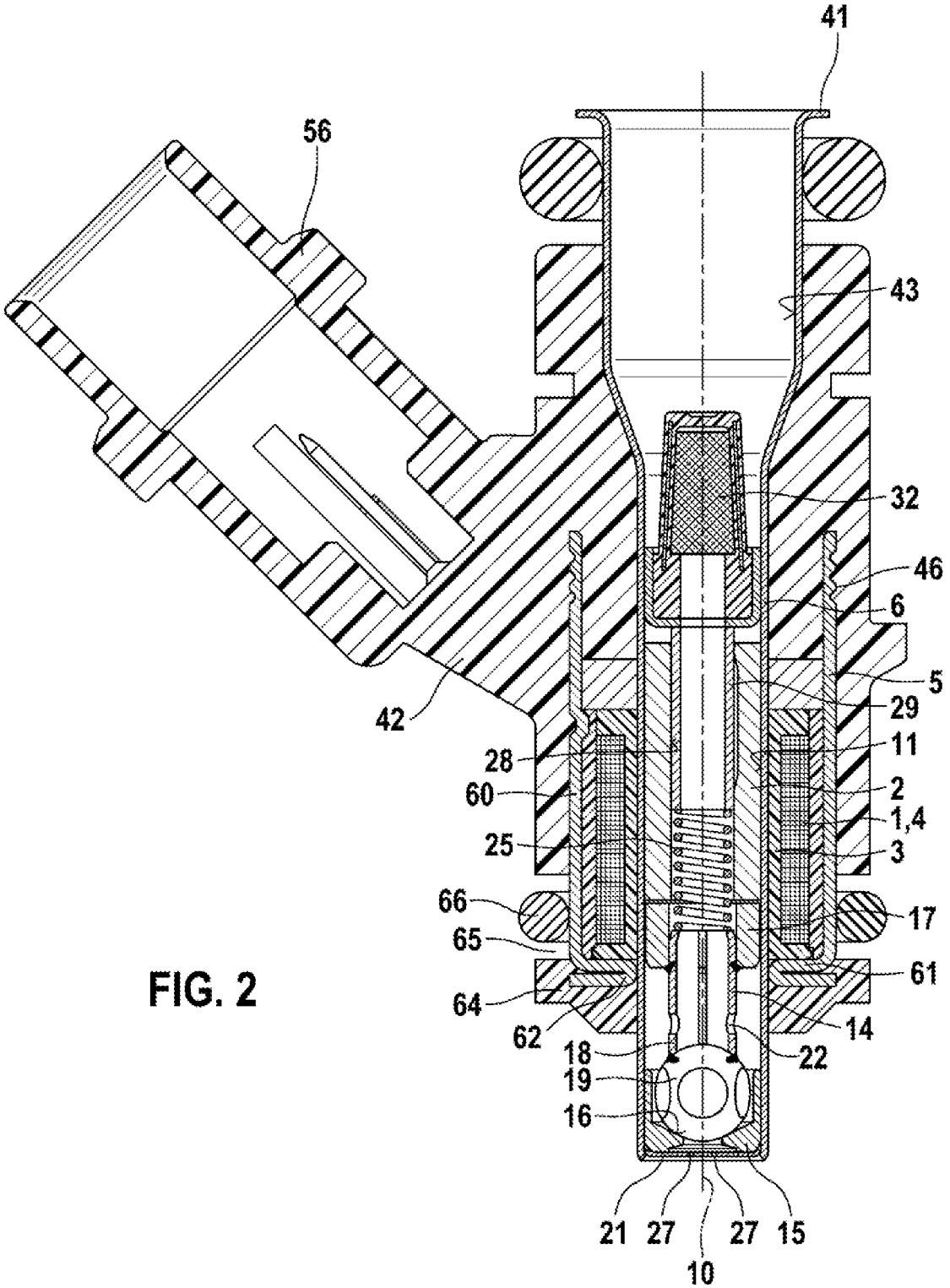
FIG. 2 shows a first embodiment of a valve according to the present invention.

FIG. 2 shows a first exemplary embodiment of a fuel injector according to the present invention. The fuel injectors of the present invention are distinguished by a very slender construction, a very small outside diameter and an overall extremely small geometrical configuration, which is not immediately apparent from FIGS. 1 and 2 or 3 because the scale is not equal. The dimensioning according to the invention shall be explained in greater detail in the following. In the present example, valve sleeve 6 runs over the entire length of the valve. Outer magnetic-circuit component 5 is cup-shaped, and may also be denoted as magnetic cup. Magnetic-circuit component 5 has a casing section 60 and a bottom section 61. For example, at the upstream end of casing section 60 of outer magnetic-circuit component 5, a labyrinth seal 46 is provided, with which the sealing with respect to plastic coating 42 surrounding magnetic-circuit component 5 is achieved. Bottom section 61 of magnetic-circuit component 5 is distinguished by a fold 62, for instance, so that a double layer of folded magnetic-circuit component 5 is present below solenoid coil 1. First of all, folded bottom section 61 of magnetic-circuit component 5 is retained in a defined position by a support ring 64 which is mounted on valve sleeve 6. Secondly, support ring 64 defines the lower end of an annular groove 65, into which a sealing ring 66 is inserted. The upper end of annular groove 65 is established by a bottom edge of plastic coating 42. Due to a suitable dimensioning of the magnetic circuit, the outside diameter $D_M$ of outer magnetic-circuit component 5 in the peripheral region of solenoid coil 1 amounts to only $10.5<D_M<13.5$ mm. Since in the present embodiment of magnetic-circuit component 5, casing section 60 runs cylindrically, at no point does magnetic-circuit component 5 have a larger outside diameter than an outside diameter of the aforesaid region. Sealing ring 66 is mounted directly on the outer periphery of outer magnetic-circuit component 5 in the area of casing section 60, so that even with its sealing ring 66 slid radially outside on the magnetic circuit, the fuel injector is still able to be mounted in receiving bores on the intake manifold with an inside diameter of 14 mm. Sealing ring 66 may be provided in the peripheral region of outer magnetic-circuit component 5 at its largest outside diameter.

In order to be able to realize the smallest possible outside diameter of the magnetic circuit, first and foremost, the components on the inside, such as core 2 serving as internal pole and armature 17, must also be dimensioned very small accordingly. Therefore, in the new dimensioning of the magnetic circuit, 2 mm was established as minimal necessary size for the inside diameters of core 2 and armature 17. The inside diameters of the two components, core 2 and armature 17, determine the inner flow-through cross-section, it having been discovered that, given an inside diameter of 2 mm, it is still possible to adjust the dynamic injection quantity with a return spring 25 on the inside, without the tolerance of the inside diameter of return spring 25 influencing the static flow rate. Various sizes and parameters play an essential role in the design of the magnetic circuit. Thus, it is optimal to diminish minimal spray-discharge quantity $q_{min}$, more and more to the greatest extent possible. In so doing, however, care must in turn be taken that spring force $F_F$>3 N must be maintained in order to guarantee the imperviousness of <1.0 $mm^3$/min customary today and also required in the future. Given a sealing diameter of d=2.8 mm, in the present design, a spring force of $F_F$>3 N corresponds to the static magnetic force in the case of a tension $U_{min}$ of $F_{sm}$>5.5 N.

The maximum magnetic force $F_{max}$ is likewise a significant variable for the design of a fuel injector with electromagnetic drive. If $F_{max}$ is too small, thus, <10 N, for instance, this may cause what is termed a "closed stuck." This means that the maximum magnetic force $F_{max}$ is too small to overcome the hydraulic adhesive force between valve-closure member 19 and valve-seat surface 16. In this case, in spite of being energized, the fuel injector would not be able to open.

Therefore, the new geometry of the fuel injector was determined, first and foremost, under the boundary conditions with regard to the variables $q_{min}$, $F_F$ and $F_{max}$. According to the invention, in optimizing the geometry of the magnetic circuit, it was discovered that the outside diameter $D_A$ of armature 17 represents an essential variable. In this context, the optimal outside diameter of armature 17 is 4.0 mm<$D_A$<5.9 mm. From this, it is possible to derive the dimensioning of outer magnetic-circuit component 5, an outside diameter $D_M$ of magnetic-circuit component 5 of 10.5 to 13.5 mm guaranteeing the full functionality of the magnetic circuit, even given a DFR (dynamic flow range) increased considerably compared to known injectors. Due to the further reduction of $q_{min}$, made possible because of the special dimensioning of the magnetic circuit, success has been achieved in particularly advantageous manner, in attaining a DFR which is greater than 17. In this context, the DFR is calculated as the quotient of $q_{max}/q_{min}$.

After determining the optimal outside diameter $D_A$ of armature 17, according to the invention, the axial extension of armature 17 was reduced, while maintaining the full functionality of the magnetic circuit. Because of the savings in material due to the optimized design and dimensioning of valve needle 14, entire axially movable valve needle 14, including armature 17 and valve-closure member 19, advantageously has a mass of only m<=0.8 g, valve needle 14 having a longitudinal extension along longitudinal valve axis 10 which is greater than the greatest radial expanse of valve needle 14. Valve needle 14 may have a mass m of 0.6 g to 0.75 g. Such a small mass of the moving valve component leads to especially advantageous reductions in noise during operation of the fuel injector compared to the noises generated today by known manifold injectors.

In the embodiment according to FIG. 2 having a thin-walled valve sleeve 6 straight through, the optimized dimensioning provides a wall thickness t of 0.15<t<0.35 mm for valve sleeve 6, at least in the area of the working air gap, thus, in the lower core area and in the upper armature area. In this embodiment, a zone having a magnetic flux density of 0.01 T<B<0.15 T is provided as magnetic choke in the area of the working air gap in valve sleeve 6. The form of the fuel injector having the construction of valve sleeve 6 described above allows the lift to be adjusted by shifting core 2 within valve sleeve 6.

Figure 3:
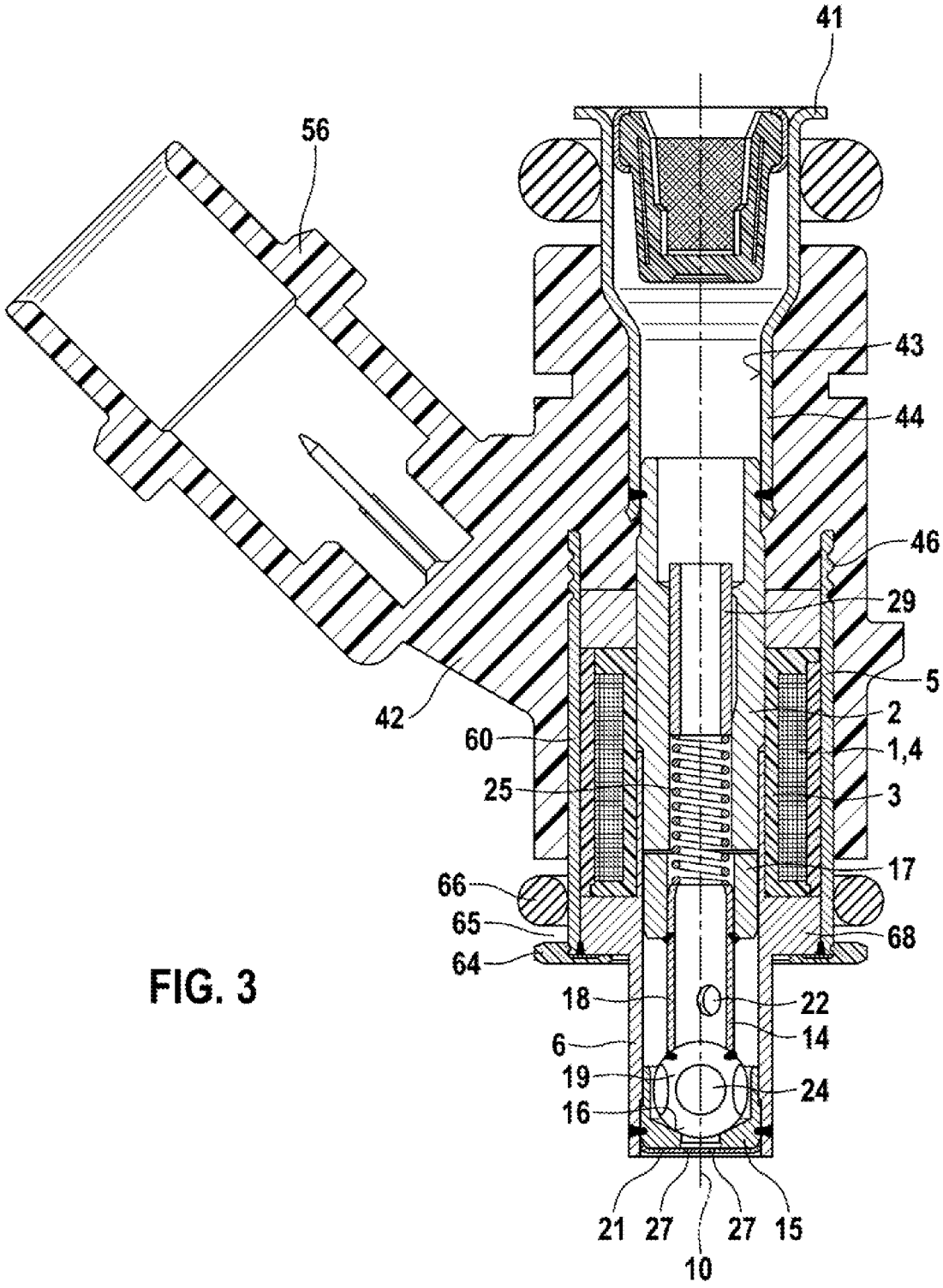
FIG. 3 shows a second embodiment of a valve according to the present invention.

The geometrical and dimensioning observations made up to this point also hold true analogously for a fuel injector in another implementation, as shown in FIG. 3. This fuel injector according to FIG. 3 differs from that according to FIG. 2 mainly in the area of valve sleeve 6, core 2 and outer magnetic-circuit component 5. Valve sleeve 6 is shorter here, and extends from the end of the valve on the spray-discharge side only into the area of solenoid coil 1. Upstream of movable valve needle 14 having armature 17, valve sleeve 6 is joined firmly to tubular core 2. This means that it is not possible here to adjust the lift by shifting core 2 within valve sleeve 6. At its axially opposite end, core 2 is in turn secured to a pipe 44 of fuel-inlet connection 41, the pipe running concentrically relative to longitudinal valve axis 10. In this respect, no thin-walled valve sleeve 6 throughout the entire length of the valve is present in this implementation. In the area of the working air gap, valve sleeve 6 is now furnished with a zone having a magnetic flux density of B<0.01 T as magnetic separation. In forming outer magnetic-circuit component 5, a bottom section was omitted, so that component 5 has a tube shape. This is possible, since valve sleeve 6 has a flange-like collar 68 projecting radially outwards, on whose outer periphery magnetic-circuit component 5 rests, and to which it is secured, e.g., by a circumferential welded seam. Support ring 64 is implemented as a flat, disk-shaped flange. Entire axially movable valve needle 14, including armature 17 and valve-closure member 19, has a mass of only m<=0.8 g in this embodiment variant of the fuel injector, as well.

What is claimed is:

1. A fuel injector, having a longitudinal valve axis, for a fuel-injection system of an internal combustion engine, comprising: a valve needle; a valve closure member; a valve-seat member; and an excitable actuator, which includes an electromagnetic circuit having a solenoid coil, an internal pole, an outer magnetic-circuit component, and an armature, movable together with the valve needle, to actuate the valve-closure member that cooperates with a valve-seat surface on the valve-seat member; wherein the valve needle has a longitudinal extension along the longitudinal valve axis which is greater than a greatest radial expanse of the valve needle, wherein the entire axially movable valve needle, including the armature and the valve-closure member, has a mass of m<=0.8; and wherein the thin-walled valve sleeve extends over the entire axial length of the fuel injector, and the internal pole is displaceable within the valve sleeve to adjust the lift, and a zone having a magnetic flux density 0.0 IT<B<0.15 T is provided as magnetic choke in the area of the working air gap in the valve sleeve.

2. The fuel injector of claim 1, wherein an outside diameter of an outer magnetic-circuit component in a peripheral region of the solenoid coil is 10.5<$D_M$<13.5 mm.

3. The fuel injector of claim 1, wherein an outside diameter wherein an outside diameter $D_A$ of the armature is 4.0 mm<$D_A$<5.9 mm.

4. The fuel injector of claim 1, wherein a wall thickness t of the valve sleeve, at least in an area of a working air gap so as to be in a lower core area and in an upper armature area, is 0.15<t<0.35 mm.

5. The fuel injector of claim 1, wherein the outer magnetic-circuit component is cup-shaped, and in this sense, has a casing section and a bottom section.

6. The fuel injector of claim 5, wherein the bottom section is double-layered due to a fold.

7. The fuel injector of claim 1, wherein the thin-walled valve sleeve extends from the discharge-side end of the fuel injector into the area of the solenoid coil, the internal pole being mounted immovably on the valve sleeve, and wherein a zone having a magnetic flux density B<0.01 T is provided as magnetic separation in the area of the working air gap in the valve sleeve.

8. The fuel injector of claim 7, wherein the valve sleeve has a flange-like collar projecting radially outwards, on whose outer periphery the magnetic-circuit component rests, and to which it is secured.

9. The fuel injector of claim 1, wherein a sealing ring is mounted directly on an outer periphery of the outer magnetic-circuit component.

10. The fuel injector of claim 9, wherein the sealing ring is in a peripheral region of the outer magnetic-circuit component at its largest outside diameter.

* * * * *